US005203239A

United States Patent [19]

Sergan et al.

[11] Patent Number: 5,203,239

[45] Date of Patent: * Apr. 20, 1993

[54] TORQUE WRENCH

[75] Inventors: Anthony J. Sergan, Farmington; George L. Castle, Perryville, both of Conn.

[73] Assignee: Barnes Group Inc., Bristol, Conn.

[ * ] Notice: The portion of the term of this patent subsequent to Oct. 15, 2008 has been disclaimed.

[21] Appl. No.: 774,678

[22] Filed: Oct. 11, 1991

Related U.S. Application Data

[63] Continuation-in-part of Ser. No. 526,927, May 22, 1990, Pat. No. 5,056,384.

[51] Int. Cl.[5] ..... B25B 13/40

[52] U.S. Cl. ..... 81/57.39

[58] Field of Search ..... 81/57.39, 57.4, 467, 81/478, 481; 29/407

[56] References Cited

U.S. PATENT DOCUMENTS

| | | | |
|---|---|---|---|
| 1,970,179 | 8/1934 | Miller | 81/57 |
| 2,069,882 | 2/1937 | Hall | 81/57 |
| 2,299,956 | 10/1942 | Stever | 81/54 |
| 2,910,901 | 4/1955 | Ryd | 81/52.3 |
| 2,961,904 | 11/1960 | Sergan | 81/60 |
| 3,625,095 | 12/1971 | Barnett et al. | 81/57.18 |
| 3,686,983 | 8/1972 | Flagge | 81/52.4 |
| 3,868,872 | 3/1975 | Wing | 81/52.4 R |
| 4,137,800 | 2/1979 | Austin | 81/57.39 |
| 4,398,598 | 8/1983 | Fabrygel | 81/57.39 |
| 4,409,865 | 10/1983 | Krautter et al. | 81/57.39 |
| 4,506,567 | 3/1985 | Makhlouf | 81/57.3 |
| 4,706,527 | 11/1987 | Junkers | 81/57.39 |
| 4,744,271 | 5/1988 | Collins | 81/57.39 |
| 4,838,130 | 6/1989 | Snyder | 81/57.39 |

FOREIGN PATENT DOCUMENTS

| | | | |
|---|---|---|---|
| 957918 | 11/1974 | Canada | 138/41 |
| 747709 | 7/1980 | U.S.S.R. | 81/57.39 |

*Primary Examiner*—James G. Smith
*Attorney, Agent, or Firm*—Pennie & Edmonds

[57] ABSTRACT

A torque wrench in which the torquing forces are applied to the article torqued equally and oppositely in a diametrically opposed manner. The body of the wrench comprises a two-part metal frame which permits the wrench to be significantly lighter than prior art wrenches. The applied forces may be provided by at least four hydraulic cylinders mounted in a frame, equally spaced about a central opening in which the article to be torqued is gripped. The fluid power cylinders apply force to the legs of a rotatable drive means which, in turn, rotates the member torqued. In order to provide rotation in both directions, each cylinder of the wrench is pivotable to permit the drive means to be selectively rotated in opposite directions.

20 Claims, 9 Drawing Sheets

TORQUE WRENCH

RELATED APPLICATION

The present application is a continuation-in-part of Ser. No. 07/526,927, filed May 22, 1990, now U.S. Pat. No. 5,056,384, issued Oct. 15, 1991.

BACKGROUND OF THE INVENTION

The invention relates to torque wrenches and more particularly to a light-weight, portable torque wrench wherein the torquing force is supplied by fluid power cylinders arranged such that equal, and diametrically opposed forces are applied to the part being torqued without induced side loading.

Many current applications require high torquing forces to be applied with great precision, while simultaneously maintaining a precision alignment of the parts being joined. This is true, for example, in the assembly and repair of jet engines and other high speed machinery. For example, the removal or installation of a main rotor shaft may require torques exceeding 6000 fb.lbs. while maintaining tolerances of less than 0.001 inches. It has been found that prior art torque wrenches, such as those discussed below, can not always meet these requirements. A typical prior art design utilizes an offset, single mechanical moment arm or single hydraulic ram assembly which has the tendency to cause side loading, especially at high torques. Such side loading can lead to bending or eccentricity of the parts being joined. Even a slight eccentricity, for example, in a turbine shaft, can cause unacceptable run-out with an attendant increase in engine vibration, leading to premature engine failure.

In the field of torque wrenches there is a wide selection of known wrenches designed for particular applications. Even in the somewhat narrower field of fluid power torque wrenches there is a great variety of designs. U.S. Pat. No. 4,137,800 to Austin, for example, discloses a torque wrench in which a hydraulic cylinder forces a slide block against a single torque arm causing the rotation of a ratchet mechanism. U.S. Pat. No. 3,686,983 to Flagge discloses a torque-applying device wherein the torquing force is supplied by a hydraulic motor. One example of a specialized torque wrench available in the prior art is disclosed in U.S. Pat. No. 4,838,130 to Snyder which describes a hydraulically actuated power wrench specifically adapted for torquing one of a plurality of adjacently spaced bolts. The Snyder '130 wrench comprises a hydraulic cylinder which acts on a pivotable lever to turn a bolt. The reaction force due to the application of torque is borne by an adjacent bolt through a specially shaped anchoring ring. U.S. Pat. Nos. 3,868,872 and 4,706,527 illustrate further examples of torque wrenches where the torquing force is provided by a hydraulic cylinder acting through a lever arm.

U.S. Pat. Nos. 3,625,095 to Barnet et al. and 4,398,598 to Fabrygel and also USSR patent No. 747,709 each disclose a torquing device that applies a torquing force through a single opposed pair of linear forces. While it may appear that a single opposed pair of linear forces (a force couple) would theoretically provide a balanced torquing force, in reality it does not do so. This is due to the high torque and the practical problems encountered in actual manufacture and operation of the prior art wrenches. These prior art devices utilize a hollow cylinder or ring for converting linear force to angular torquing force. During torquing, and especially at high break-away and torque-up torques, the hollow cylinder or ring will behave as if it were essentially fixed against rotation due to the reaction forces created in the part being torqued.

In general, if a single pair of parallel and opposed forces is applied along the circumference of a fixed cylinder or ring, as in the prior art devices, the circumference of the cylinder or ring will tend to become elliptical if the forces are great enough. If the cylinder is provided with extending legs, to facilitate the application of forces, the elliptical effect is increased due to the bending moment created at the interface of the leg and cylinder. Depending on the means by which torque is transmitted from the wrench to the article being torqued, this deformation can also be transmitted to the article.

Generally, the use of heavy bearings to compensate for the elliptical effect has been the attempted solution in the prior art for high torque applications. However, there are at least two significant disadvantages to such construction: First, deformation will still occur in the ring or cylinder to the degree allowed by the bearing tolerances. Also, the load carried by the bearings creates frictional losses in the bearings, which result in inaccuracies in torque measurement.

The two disadvantages of prior art wrenches discussed above are present even if all parts of the device are perfectly aligned, which in actual practice rarely occurs. In actual practice, eccentricities are present due to machining tolerances in both the wrench and the article being torqued. Further eccentricities may be introduced by slight misalignment or out-of-roundness of the article being torqued. These eccentricities will cause a single opposed pair of torquing forces to act with unequal moment arms, thereby applying unequal torques. This unequal application causes the elliptical effect to be exaggerated where the moment arm is longer, causing an egg shape as opposed to a symmetrical ellipse. The creation of an egg shape means that unequal forces are acting against the supporting bearings. Thus, a resultant force is created which can be transmitted to the article being torqued and cause significant damage to that article. Such a resultant force is referred to as "induced side loading".

U.S. Pat. No. 2,961,904 discloses a hydraulically actuated wrench which attempts to address the failings of the prior art by applying a three-point balanced torquing force. The '904 wrench is provided with a central drive member having a ratcheted opening for engaging a nut. The drive member also has three arms equally spaced at 120 degree intervals extending radially from the drive member. Three pairs of fixed, opposed hydraulic cylinders act on these arms to provide the torquing force. The cylinders are equally spaced about the drive member in order to exert a balanced force on the work piece. The cylinders are arranged in pairs in order to enable the wrench to operate in either direction, i.e., three cylinders exert a clockwise force and three exert a counter-clockwise force.

While the patented wrench disclosed in the '904 patent is an improvement over the previously available wrenches in that it applies a generally balanced torquing force, its design is still not satisfactory for all applications. The triangular arrangement of the cylinders, while generally providing balanced forces, is inherently unstable due to the fact that each cylinder, acting on the work piece through the drive member, is not directly opposed by an equal reaction force. Therefore, the possibility exists for induced side loading to occur, causing the piston to creep on the arm of the drive member. Such creep would change the effective length of the moment arm and thus cause inaccurate torque readings.

Another disadvantage of a design using opposed cylinders for supplying torquing forces in two directions is the precision machining which is required to fabricate such a wrench. In order for the torque readings to be accurate in both directions, the center lines of the opposed cylinders must match exactly. If the center lines do not match, there will be different effective moment arms depending on which cylinder is acting. It is expensive and time consuming to precision line bore the required seat for the opposed cylinders. In large wrenches, requiring large diameter bores, the tolerance requirements alone may be sufficient to cause a center line mismatch.

In addition, paired cylinders such as are found in the '904 wrench require two travel limit valves to prevent piston over travel. This extra hydraulic valving must be placed on the outside of the wrench as a result of design size considerations. The valving is therefore subject to damage and leaking when the wrench is used under normal field conditions.

A further disadvantage of the prior art wrenches discussed above is that in order to achieve a large torque capacity, the weight and size of these wrenches are such that they are bulky and cumbersome to use. This is especially true of the wrench of the '904 patent because six cylinders are included while only three at a time are used for a particular torquing operation. This greatly increases the weight of the wrench. Portability is a very important feature in torque wrenches as described herein, especially if the wrench is to be successfully utilized at remote field installations as is required in the offshore oil industry and in many military applications.

SUMMARY OF THE INVENTION

Thus, it is an object of the invention to provide a torque wrench which applies equal, centrally balanced, diametrically opposed forces to the part being torqued in order to prevent side loading, bending or eccentricities and thereby eliminate false torque readings and ensure the greatest possible accuracy in torque application. Therefore, a feature of the invention is the arrangement of fluid power cylinders in at least two opposed pairs, each pair acting through parallel lines spaced equidistantly apart across the center of the wrench. Thus, the lines of action of all cylinders are equidistant from the center of the wrench. This feature provides the advantage that equal, centrally balanced and diametrically opposed forces are applied automatically and in all situations.

A further object of the invention is to provide such an accurate torque wrench suitable for use in tight areas which is also portable, compact, and lightweight. A feature of the invention is therefore to provide means for rotating the fluid power cylinders to act in one of two directions, ninety degrees apart. This has the advantage of allowing each cylinder to create a torque in both the clockwise and counterclockwise direction and thus reducing the weight and size of the wrench by eliminating redundant components. A further feature in this respect is a lightweight frame, which includes integral fluid passages. This provides the advantage of minimum weight while maintaining structural integrity and also minimizing the number of weight adding fluid fittings.

It is also an object of the invention to provide a hydraulic torque wrench with a minimum of external fluid fittings and components. Thus, a frame provided with internal integral fluid passages and integral bosses for attachment of main fluid components is a feature of the invention.

In general, these and other objects are achieved by a torque wrench comprising a frame; drive means for converting linear force to angular force and for engaging a device to be rotated mounted centrally in the frame; means for applying at least two pairs of equal and diametrically opposed linear forces to the drive means; and selector means for selectively rotating the direction of application of the force applying means.

The frame generally comprises two separate frame members, each member itself comprising a central support member, defining a central aperture and further defining passages therethrough for the actuating fluid. The frame also comprises individual truss members joining the central support member with an outer ring member.

The drive means comprises a cylindrical body having a central bore with a gear tooth interior surface and, in a preferred embodiment, four legs provided with clevises extending radially from and equally spaced around the outer circumference of the cylindrical body. A ratchet wheel is rotably supported within the central bore and adapted to engage a tool for connection with the article that is to be rotated. A number of pawls are pivotably supported on the ratchet wheel. The pawls are spring biased to engage the gear tooth interior surface of the central bore to provide driving engagement between the cylindrical body and the ratchet wheel. The pawls may be selectively positioned to provide driving engagement in a clockwise direction or in a counterclockwise direction.

In a preferred embodiment, the force-applying means comprises a plurality of fluid power cylinders disposed on the frame in at least two opposed pairs acting through parallel lines spaced equidistantly apart across the central aperture of the wrench. The pistons of the cylinders are pivotably linked by the clevises to one of legs of the drive means and apply equal, diametrically opposed linear forces to the drive means equidistant from its center. The force-applying means also includes a system for supplying fluid to cylinders, comprising internal fluid supply lines formed integrally with the frame. In one embodiment fluid power to the wrench may be supplied by an external pressure source. In another embodiment the fluid passages communicate with a dual acting hydraulic hand pump having an integral fluid reservoir with the pump mounted directly on the wrench. Thus, the wrench is capable of operation on remote sights or hazardous areas with the integral hand pump or with attachment of high pressure hydraulic hose lines and a separate motor driven pump.

A preferred embodiment the selector means comprises a pivot lug on one of the cylinders which extends through the front of the wrench to receive a socket or other tool for rotation. Rotation of one cylinder rotates all cylinders due to their mechanical linkage through the drive means clevises. An alternative embodiment is also described in which a separate mechanical linkage is used to rotate the cylinders.

Thus, present invention avoids the problems of the prior art by applying torquing forces in at least two opposed pairs, equally spaced around the part being torqued. This arrangement provides a substantially equidistant four-point plane stabilized torquing force that eliminates the elliptical effect and induced side loading because the dual opposed forces allow the drive means to essentially "float" in the central aperture, supported only by relatively thin sleeve bearings. Because the bearings do not have to support the drive means against deformation, the frictional losses are minimized to provide highly accurate torque measurement, even at extreme torques.

The arrangement of the forces in the present invention provides a further advantage over the prior art in that the drive means and hence the article being torqued are centralized, which tends to eliminate eccentricities during torquing. This feature further increases the accuracy of the invention and minimizes the risk of damage to articles being torqued with the invention.

DETAILED DESCRIPTION OF THE PREFERRED EMBODIMENT

The present invention is an improvement of the torque wrench described in applicant's copending U.S. patent application Ser. No. 07/526,927, now U.S. Pat. No. 5,056,384 which is incorporated in its entirety herein by reference thereto.

Figure 1:
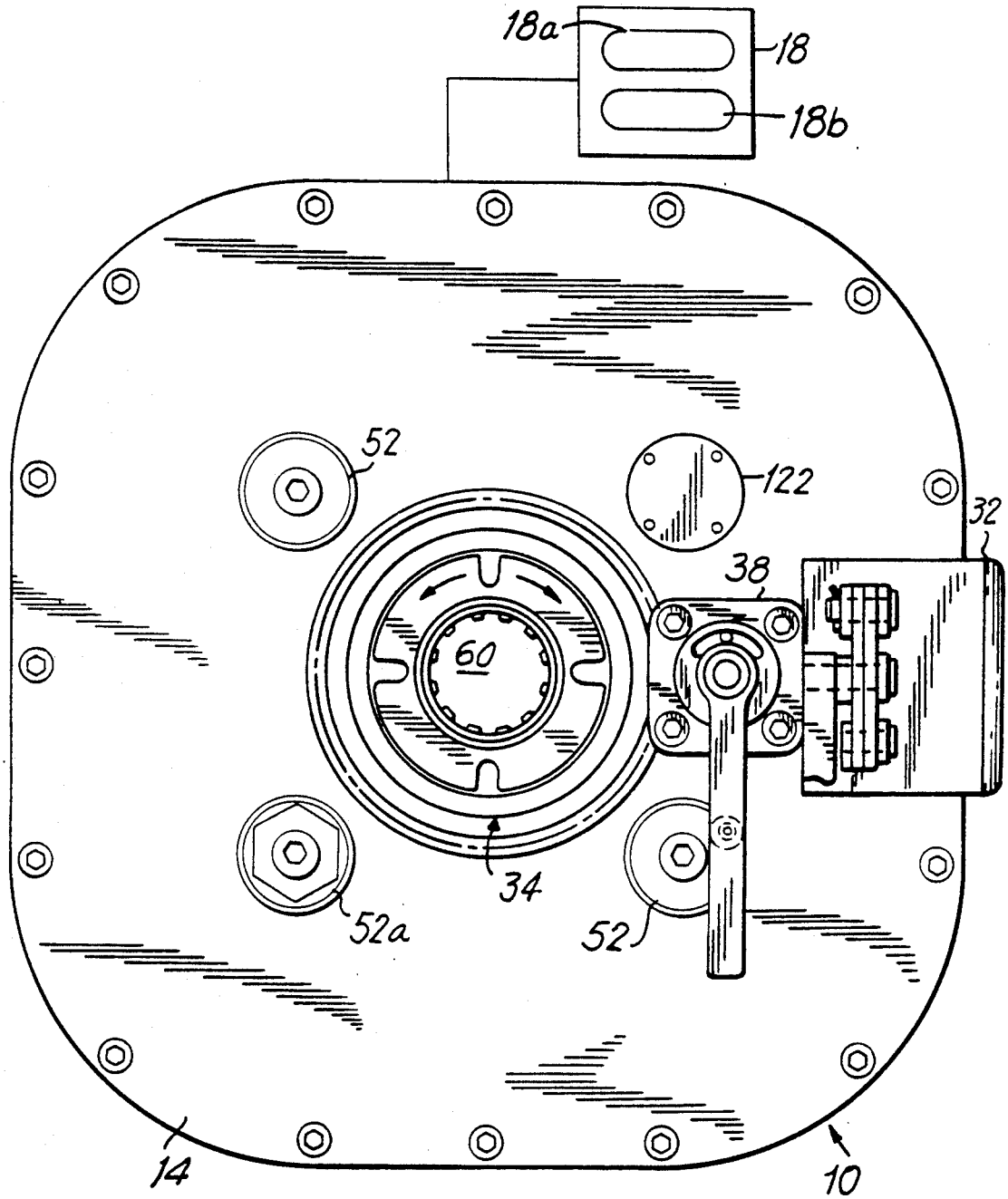
FIG. 1 is a top plan view of the hydraulic torque wrench of the present invention.

Referring to the illustrations and particularly to FIG. 1 it can be seen that a preferred embodiment of the hydraulic torque wrench 10 of the invention generally includes front structural frame member 14 (a rear structural frame member 16 is not visible in this figure), electronic package 18, pump 32 (with handle 22 removed), four-leg ratchet mechanism 34 and three-way selector valve 38. Pump 32 and valve 38 are required only in the self-contained embodiment of the invention, which will be described in greater detail below.

Figure 2:
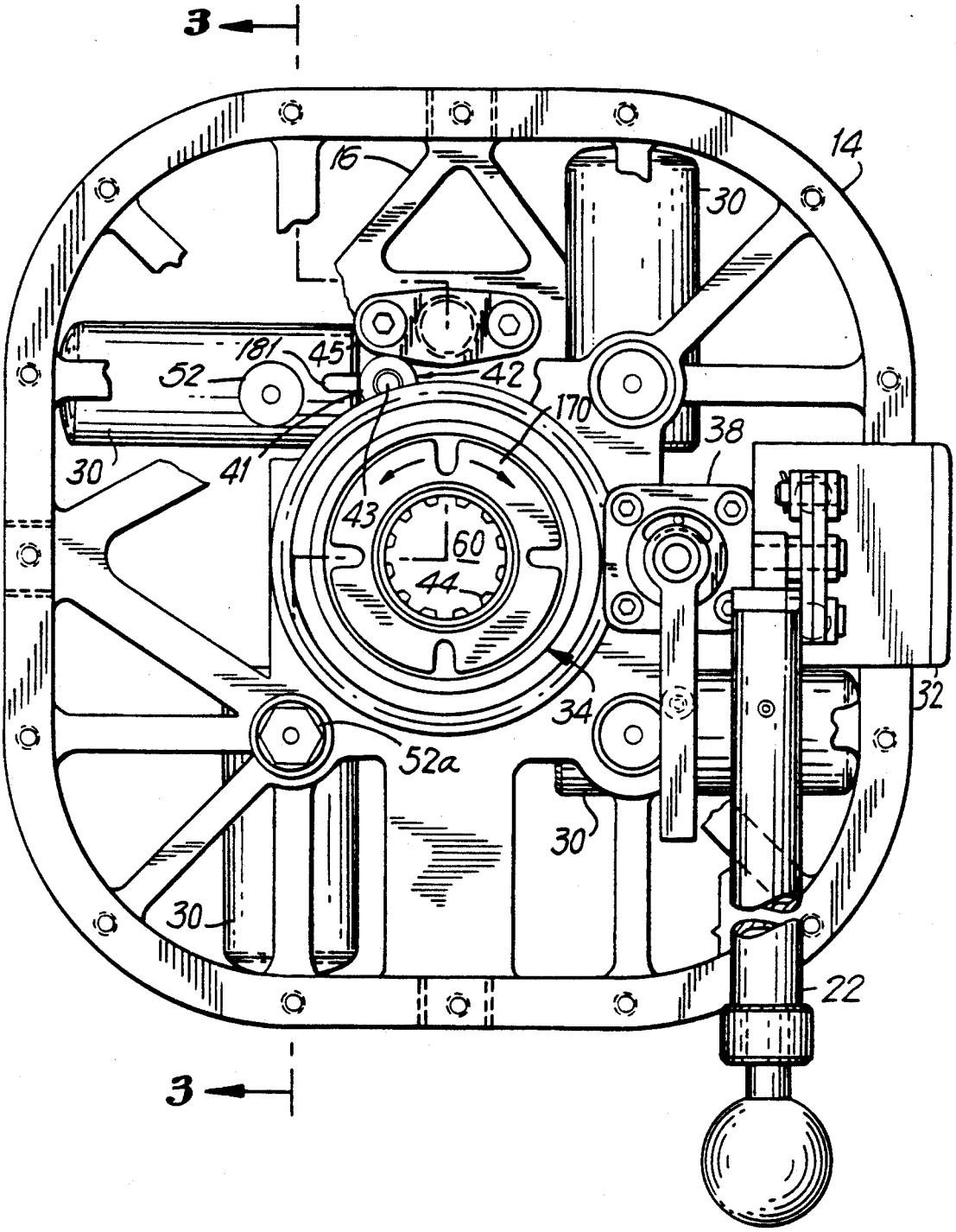
FIG. 2 is a top plan view of the present invention with the majority of the front frame member broken away.
Figure 3:
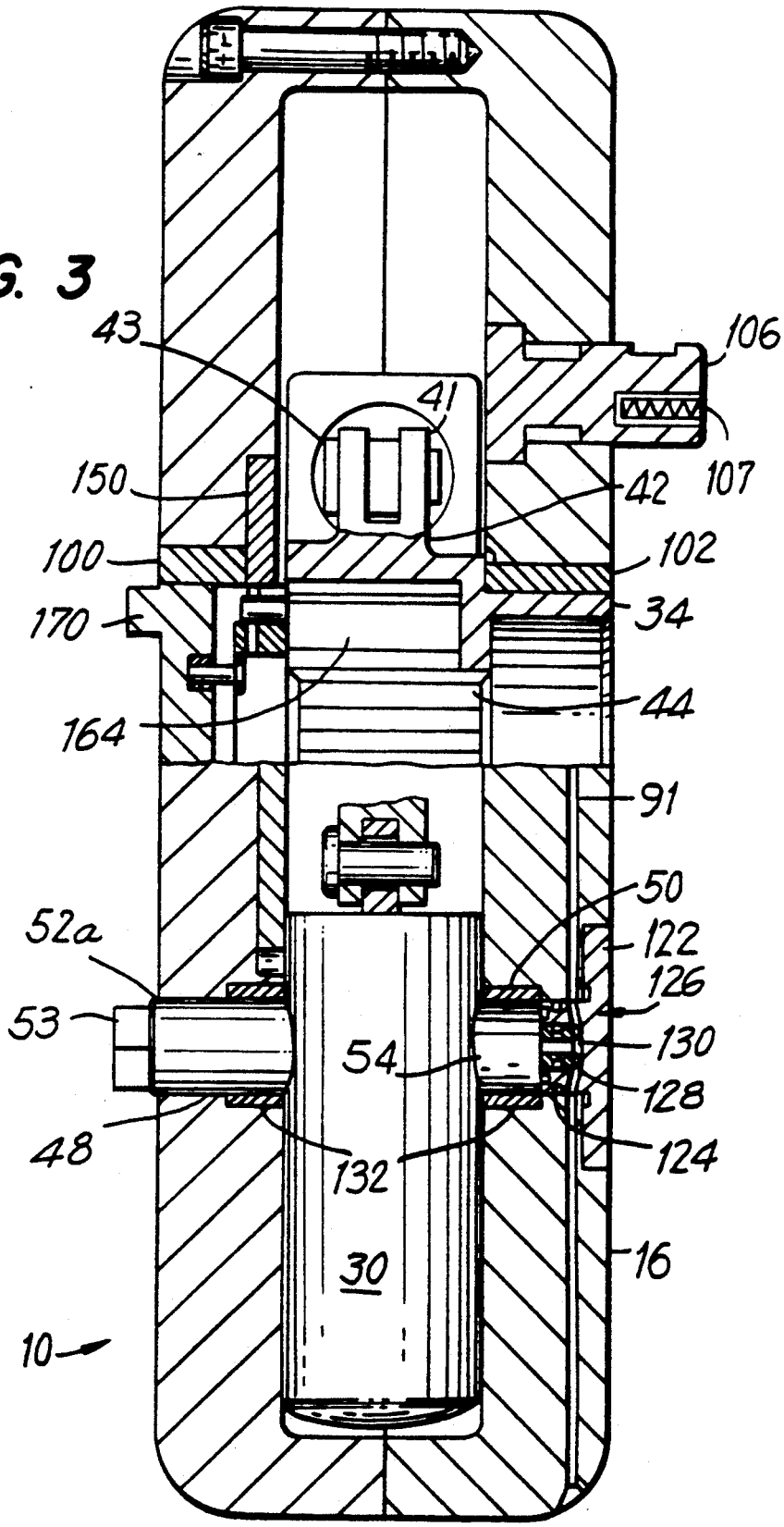
FIG. 3 is a section view through line 3—3 of FIG. 2.

Before addressing further details of the invention, it is appropriate to first provide a brief overview of the construction and operation of the wrench 10 in order to gain a general understanding of the purpose of and relationship between the main components, which subsequently will be described in detail. Referring to FIGS. 2 and 3, four fluid power cylinders 30 are located in a square configuration ninety (90) degrees apart surrounding the ratchet mechanism 34. The cylinders 30 provide means for applying equal and diametrically opposed forces to the legs 42 of the four-leg ratchet mechanism 34 mounted in the center of the wrench. The four-leg ratchet mechanism 34 provides means for converting the linear force applied by the pistons 40 to an angular or torquing force. The four-leg ratchet mechanism 34 is provided with a central splined ring 44 for accepting a tool which engages the part to be torqued. Fluid power to the cylinders 30 is provided by remote pressure source, or in the self-contained embodiment, by dual action hand pump 32, which forms an integral part of the wrench 10. The actuating fluid flows through passages in rear frame member 16 to the cylinders 30.

In order to provide both torquing and untorquing forces, using only one set of cylinders and without turning the wrench over, a novel means for rotating the direction of force application of the cylinders 30 is provided. The piston 40 of each cylinder 30 is pivotably connected to four-leg ratchet mechanism 34 by clevis 41 and pin 43. The cylinders are mounted on pivot lugs 52,54 to allow rotation. Pivot lug 52*a* of one cylinder extends upwardly through front frame 14. Rotation of pivot lug 52*a* ninety degrees rotates all of the cylinders ninety degrees due to the linkage with the four-leg ratchet mechanism, to allow the cylinders to act in two different directions.

The torque wrench 10 according to the present invention is a universal tool which may be used with many different types of equipment and in many different applications. In order to secure the wrench 10 in each different application, without modifying the wrench itself, the wrench is fitted on a torque reaction adapter (not shown). This adapter is specifically designed for a particular work piece to accept torque reaction loads when torques are applied to the assembly. Shear lugs 106 are provided to secure the wrench 10 to an adapter. Such torque reaction adapters are known in the art and could be easily made to fit the wrench according to the present invention by a person of ordinary skill in the art. Wheatstone bridge type strain gauges 107 are provided on the shear lugs in order to measure the reaction forces. The torque reaction force is converted to torque valves by electronics package 18, to provide a highly accurate digital torque readout 18*a*. Actuation of the cylinders also may be controlled by electronics package 18, such that extension of the pistons is stopped automatically when a predetermined torque value is reached.

Figure 5:
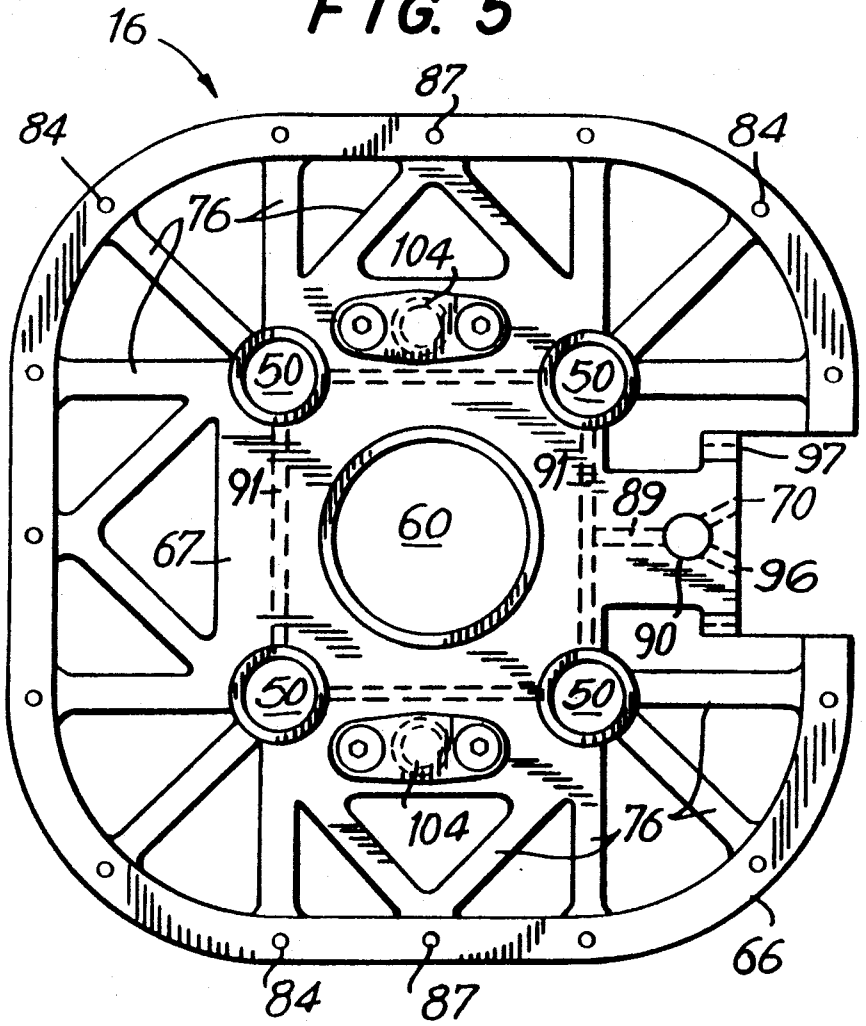
FIG. 5 is a top plan view of the rear frame member.
Figure 4:
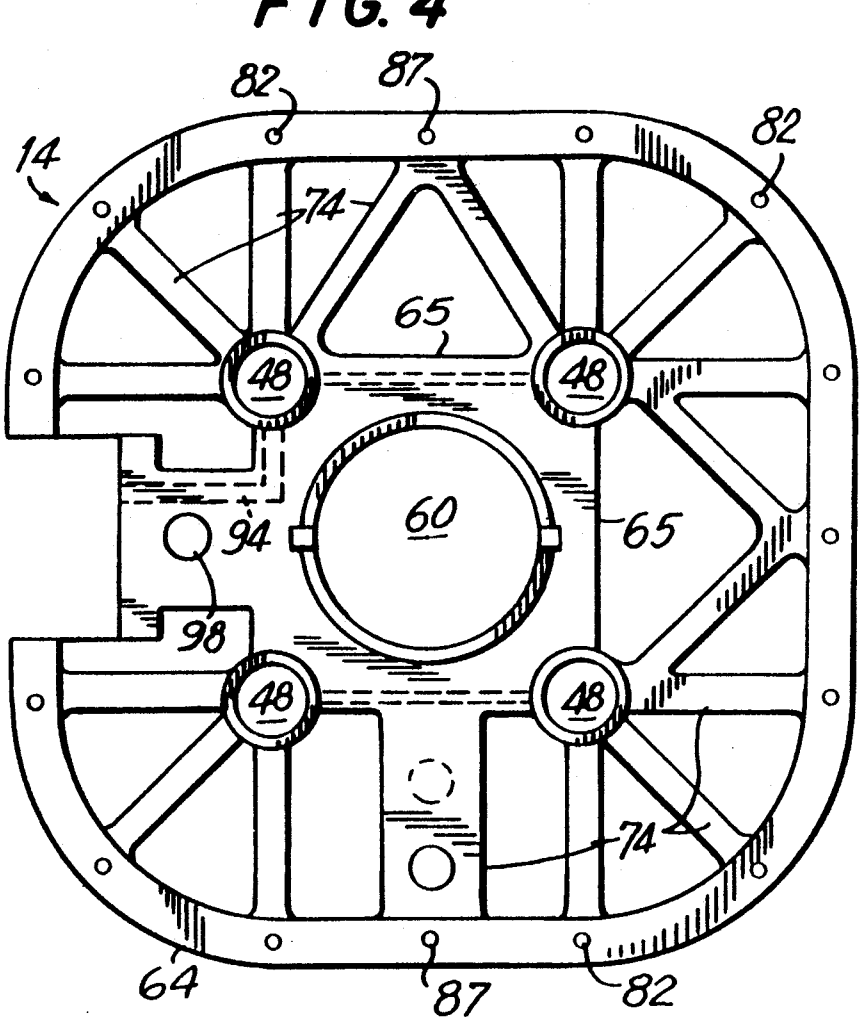
FIG. 4 is a bottom plan view of the front frame member of the present invention.

Referring now to FIGS. 4 and 5, the arrangement and function of the front and rear frame members 14,16 will be discussed in detail. In a preferred embodiment, the front and rear frame members 14,16 are aluminum, made as forgings or castings. If castings are used they may be impregnated with a plastic material in order to eliminate microporosity and thereby prevent leakage of the actuating fluid. Such an impregnation process is commonly used to eliminate porosity in castings utilized in fluid power applications.

The front and rear frame members 14, 16 are each formed as integral parts having outer ring 64,66, central support 65,67, and interior truss members 74,76. Apertures 48,50 receive cylinder pivot lugs 52,54 to allow rotation of the cylinders 30 and are formed in the central supports 65,67.

The front and rear members 14,16 are fastened together by bolts through holes 82,84 in the outer rings 64,66. Two dowels are provided in fitted holes 87 on the inside of the outer rings 64, 66 to ensure exact alignment of the frame members and to carry the shear force exerted on the frame members during a torquing operation.

Front and rear frame members 14, 16 define a central opening 60 within the central supports 65, 67. Front and rear bearings 100,102 (see FIG. 3) are located in the central opening 60 respectively on the front and rear members 14,16. On the outside of the rear frame member 16 only are provided two additional bores 104 which carry shear lugs 106. The shear lugs 106 secure the entire wrench 10 to the torque reaction adapter.

Fluid passage 91 is arranged in a square configuration around central support 67 by forming small holes in the metal of the rear frame member. Passage 89 provides fluid communication between passage 91 and three-way valve boss 90. Fluid passages 92 and 96 extend through pump boss 97 to communicate with pump 32, which is bolted onto boss 97. Hole 98 is provided in front frame member 14 to allow the valve spindle of three-way selector valve 38 to pass therethrough.

Figure 6:
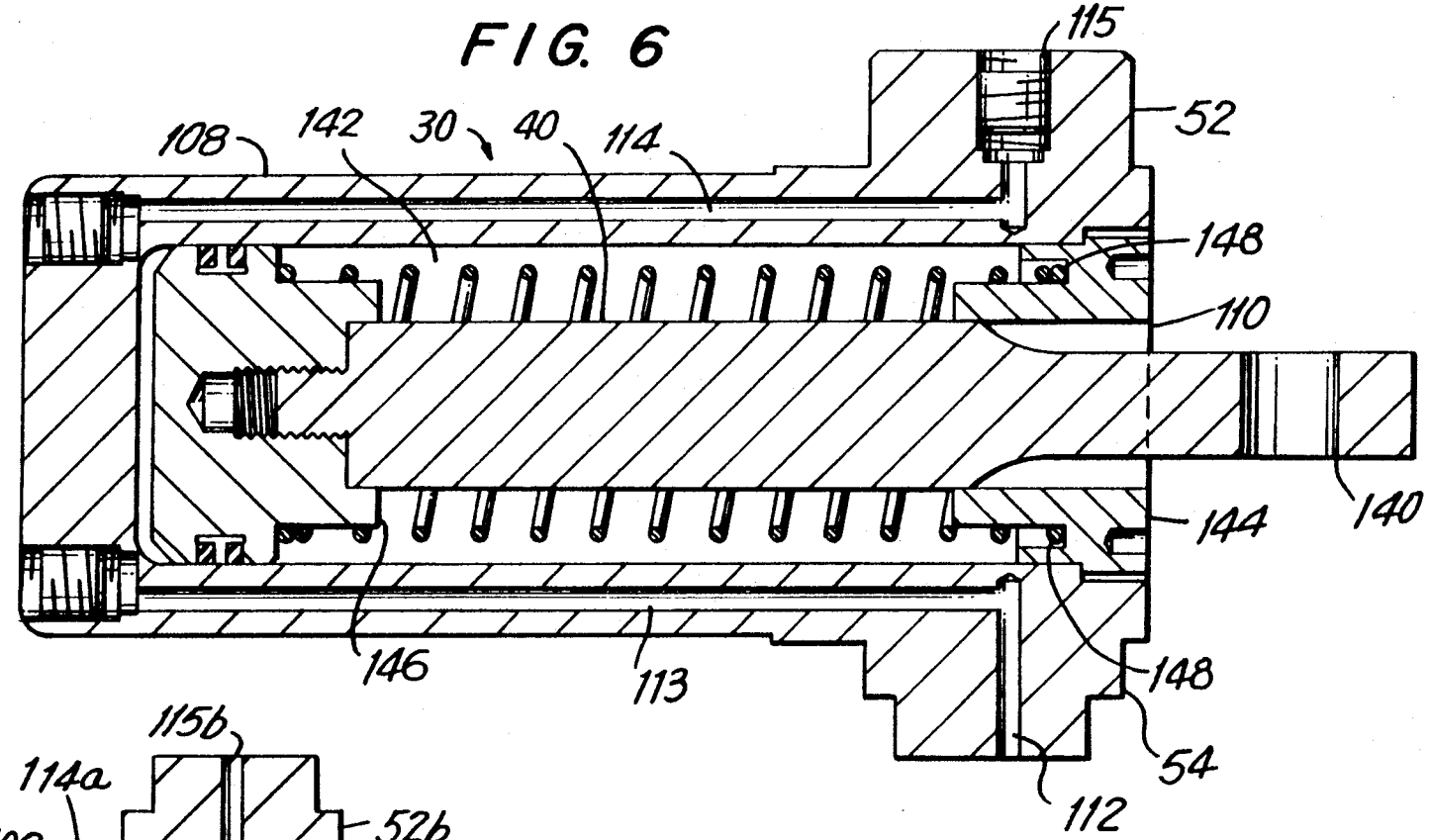
FIG. 6 is a detail section view of a cylinder-piston assembly of the present invention.

Referring to FIGS. 3 and 6, the hydraulic cylinders 30 of the present invention are described in greater detail. In FIG. 3, the cylinder 30 is shown not sectioned in order to eliminate duplication of detail shown in FIG. 6 and thereby enhance the clarity of FIG. 3. Referring first to FIG. 6, each cylinder 30 comprises a cylinder body 108 which supports piston rod 40 and provides passages 112, 113, 114, 115, drilled in cylinder body 108, for the actuating fluid. Each cylinder generally has a "T"-shape, with pivot lugs 52,54 extending from each side of the cylinder 30 near the end closest to the piston opening 110. The pivot lugs 52,54 provide means for pivotable support by the front and rear frame members 14,16. The pivot lugs 52,54 ride in apertures 48,50 in both the front and rear members 14,16. Fluid passage 112, in the center of each lug 54, communicates with fluid passage 91 in rear frame member 16. Passages 114, 115 provide a bleed passage for each cylinder.

Piston rod 40 is provided with an end 140 to cooperate with clevis 41 and pin 43 on four-leg ratchet mechanism 34. Cylinder cavity 142 is sealed at its outer end by screw-in plug 144. Piston rod 40 is seated in piston flange 146. Compression spring 148 is disposed between plug 144 and flange 146 to return the piston after a torque stroke.

Figure 6A:
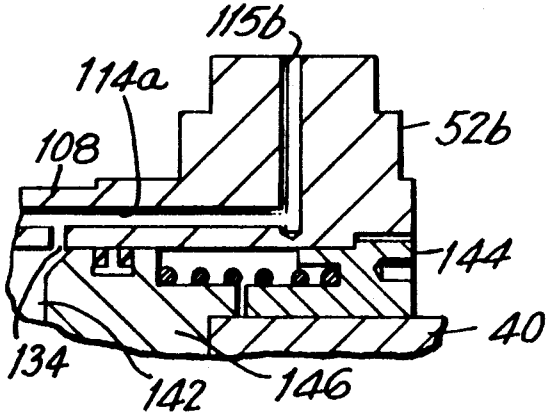
FIG. 6*a* is a partial section view illustrating the over travel relief system provided in one of the cylinders.

Included within the cylinder body 108 of one of the cylinders 30 is a relief passage 134 to prevent over travel of all pistons. Thus, three of the cylinders include upper pivot lugs 52 as shown in FIG. 6, while the fourth cylinder includes a modified pivot lug **52*b* that is similar to lower pivot lugs 54. FIG. 6*a* shows the piston rod 40 of said fourth cylinder in the over travel position. Passage 114*a* does not communicate with cavity 142 behind piston flange 146. Instead, relief passage 134 is provided close to plug 144 to provide for flow of fluid from cavity 142 when flange 146 reaches the over travel position. Fluid released through passage 134 flows back to the pump reservoir via passage 115*b* and passage 94 in front frame member 14. Passage 115*b* communicates with passage 94 via a pressure cap 122 and shear seal 124 as described below in conjunction with pivot lugs 54**.

Relief passage 134 is provided only as a safety feature. In operation of the wrench, magnetic sensor 150 (FIG. 3) automatically senses the angular rotation of ratchet mechanism 34. This information is transmitted to electronics package 18 which controls actuation of the cylinders. When the limit of travel is reached, pressure to the cylinders is automatically stopped by the electronics package. Also, electronics package 18 includes a digital readout **18*b*** of the angle of travel which may be used to calculate torque by the shaft stretch method.

In order to extend piston rods 40, three-way selector valve 38 is set to direct actuating fluid under pressure from pump 32 through passage 92 and into passages 89 and 91 (FIG. 5). Once the limit of travel of the pistons is reached, the selector valve is reset to direct fluid through passage 96 and into the pump reservoir due to the action of spring 148 returning the piston rod.

Pump 32 and three-way selector valve 38 are included only in the self-contained embodiment of the wrench. A remote controlled embodiment may also be provided with pressurized actuating fluid provided by a separate pressure source such as an electric hydraulic pump and selector valve which may be directly controlled by electronics package 18. Thus, in the remote embodiment, pump 32 and three-way selector valve 38 are eliminated, with their functions accomplished by the remote pressure source. Therefore pump boss 97, valve boss 90, hole 98 and passages 92 and 96 are not required in the remote embodiment. Instead, passage 89 simply extends to the outside of the wrench and is provided with an appropriate fluid fitting for connection to the pressure source.

Referring to FIG. 3, pivot lugs 52,54 of cylinder 30 are received in apertures 48, 50. Bearings 132 are provided around each of the pivot lugs in order to facilitate rotation of the cylinders 30. Sealing the apertures 50 on the outside of rear frame member 16 are pressure caps 122. The pressure caps 122 are provided with small passages in order to allow fluid to flow in and out of the cylinders 30 to passage 91 in rear frame member 16. A number of o-rings 124 are provided with the pressure caps 122 to prevent leakage of fluid. In order to prevent leakage at the rotating joint between the pressure cap 122 and pivot lugs 54, a shear seal 126 is provided. Shear seal 126 comprises a small, generally cylindrical rubber washer 128 which is biased against the associated pivot lug by means of wave-spring washer 130. When pressurized fluid passes through the center of the shear seal, a small amount will collect in the void provided for the wave-spring washer 130. This provides an additional force to squeeze the rubber washer 128 against the pivot log and ensures a leak-proof joint.

Pivot lugs 52 extend through front frame member 14 and are flush with the outer surface of the front frame to allow access to bleed passages 115. Pivot lug **52*a* is provided with hex or square extension 53** so it may be easily gripped for rotation of the cylinders as explained below.

Figure 7:
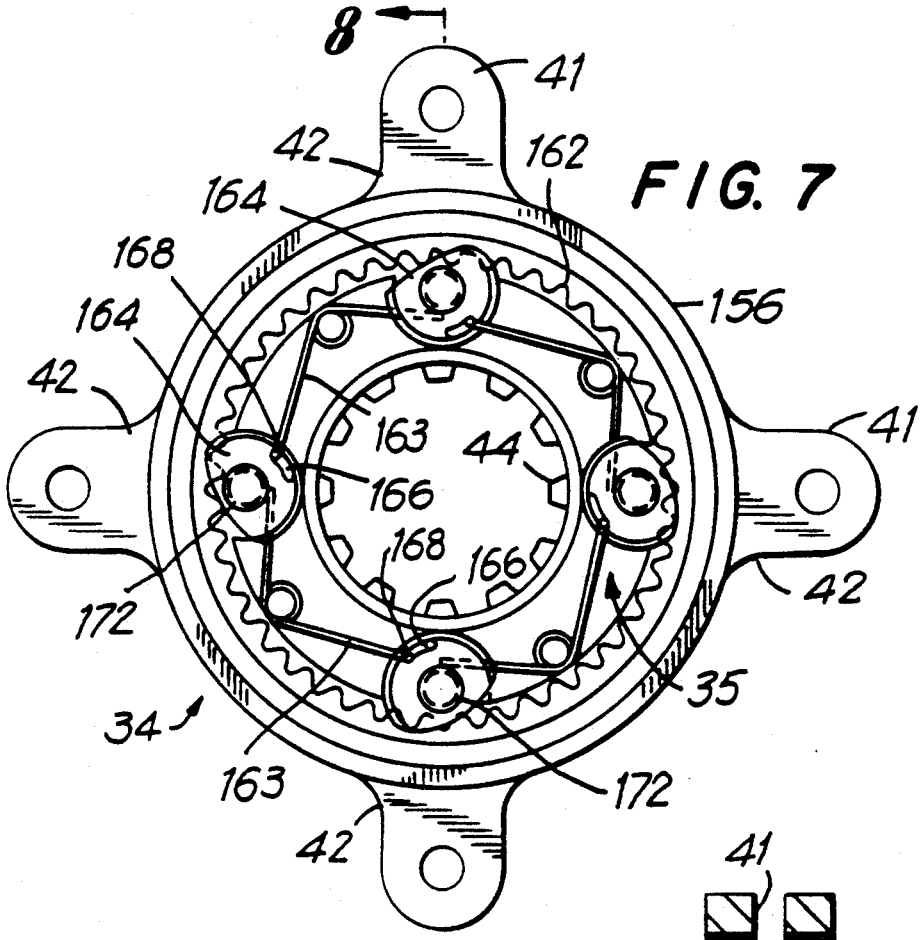
FIG. 7 is a top plan view of the four-leg ratchet mechanism of the present invention.
Figure 8:
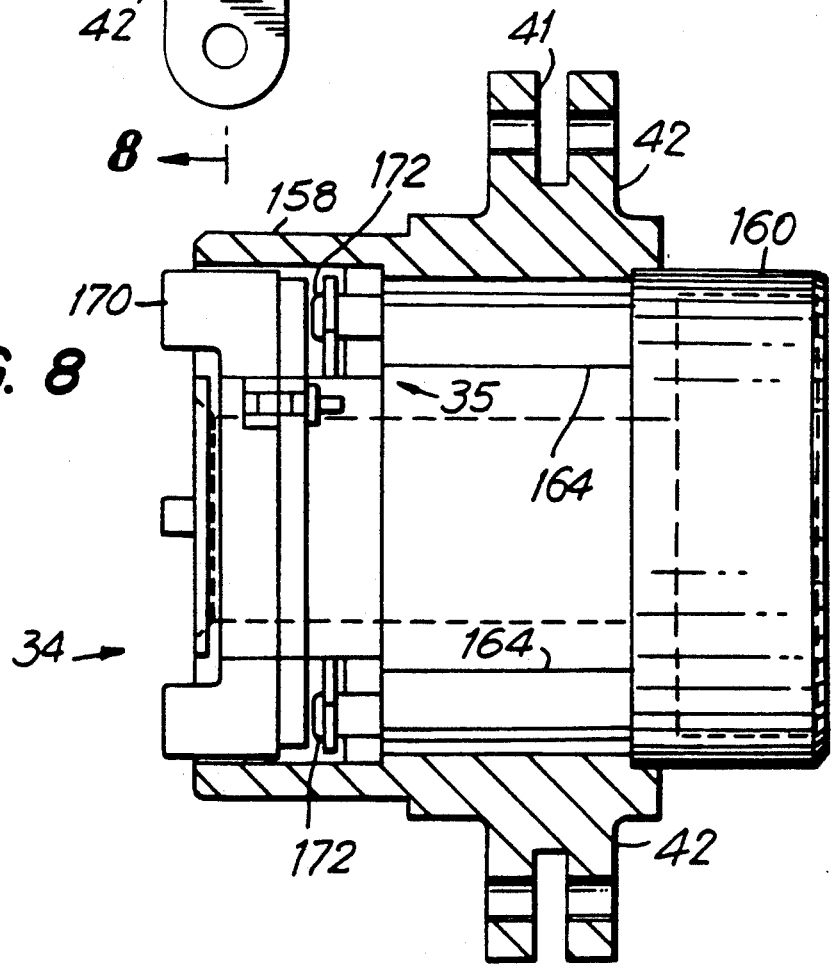
FIG. 8 is a section view through line 8—8 of FIG. 7.

The means for converting the linear motion of the hydraulic cylinders 30 to angular motion in order to apply torque is the four-leg ratchet mechanism 34, shown in detail in FIGS. 7 and 8. Ratchet mechanism 34 comprises a generally cylindrical body 156 having four legs 42 extending therefrom. A clevis 41 is provided in each leg to allow linkage of piston rod 40 with the four-leg ratchet mechanism. The legs 42 are equally spaced ninety (90) degrees apart around the circumference of the cylindrical body 156. The arrangement of the legs 42 ensures that the forces applied by the hydraulic cylinders 30 are equal and opposite forces, applied in a diametrically opposed manner such that the stability of the wrench 10 in performing a torquing operation is greatly enhanced.

The upper and lower smooth bearing surfaces 158,160 of the cylindrical body 156 ride respectively on front and rear self-lubricating thin sleeve bearings 100, 102 (shown in FIG. 3) disposed in central opening 60 of the front and rear frame members 14,16.

Teeth 162 surround the inner circumference of the cylindrical body 156. Teeth 162 cooperate with a full floating pawl mechanism 35 to provide the ratchet effect of the four-leg ratchet mechanism 34. Because piston rods 40 have a limited stroke, the angle through which the four-leg ratchet mechanism moves in a single stroke is limited. The four-leg ratchet mechanism 34 thus provides for ratcheting back for a subsequent stroke in the same direction without manually setting the wrench each time the piston rod is returned.

The full floating pawl mechanism 35 comprises four pawls 164 located ninety (90) degrees apart in order to fully engage the teeth 162. By providing the teeth 162 on an inside surface, with the pawls 164 in the interior, the arrangement provides a roll-in or self-locking action which will ensure effective engagement even if the pawl springs 163 become weakened. Extending up through a small arched slot 166 in each pawl is a pin 168 which communicates with the reverse knob 170 which is removed in FIG. 7 to reveal the pawl mechanism.

The reverse knob 170 is shown in FIGS. 1, 2 and 8. When selecting between torquing and untorquing operations, the reverse knob 170 is rotated to position the pawls 164 for proper engagement with the teeth 162. The pins 168 engage the end of the arched slot 166 and rotate each pawl 164 around the pawl screw 172 to cause the pawls 164 to change position. The pawl springs 163 maintain the pawls 164 in position once the reverse knob 170 is rotated. A spline 44 forms the inside of the pawl mechanism. The spline 44 is adapted to securely hold a tool, such as a hexagonal socket, for turning a nut or other piece to be torqued.

A preferred means for rotating the cylinders to provide for torque application in both the clockwise and counter clockwise direction, without turning over or otherwise removing the wrench from the work piece is based on the fact that all piston rods are mechanically linked. As previously explained, each piston rod 40 is pivotably linked to four-leg ratchet mechanism 34 by a clevis 41 and pin 42. (This arrangement is most clearly illustrated in FIG. 9 with the alternative embodiment described below.) Four-leg ratchet mechanism 34 floats freely for rotation in aperture 60 supported by light weight bearing 100 and 102. Therefore, rotation of any one cylinder around its pivot lugs 52,54 causes the remaining cylinders to rotate in the same direction by virtue of their mechanical linkage through ratchet mechanism 34. For this reason, one of the pivot lugs **52*a* is provided with a hex or square extension 53, which extends beyond front frame member 14 to facilitate gripping by a socket or other tool for rotation of the cylinders. Prior to rotation, piston rods 40 must be fully retracted into cylinders 30** to provide clearance for rotation.

Figure 9:
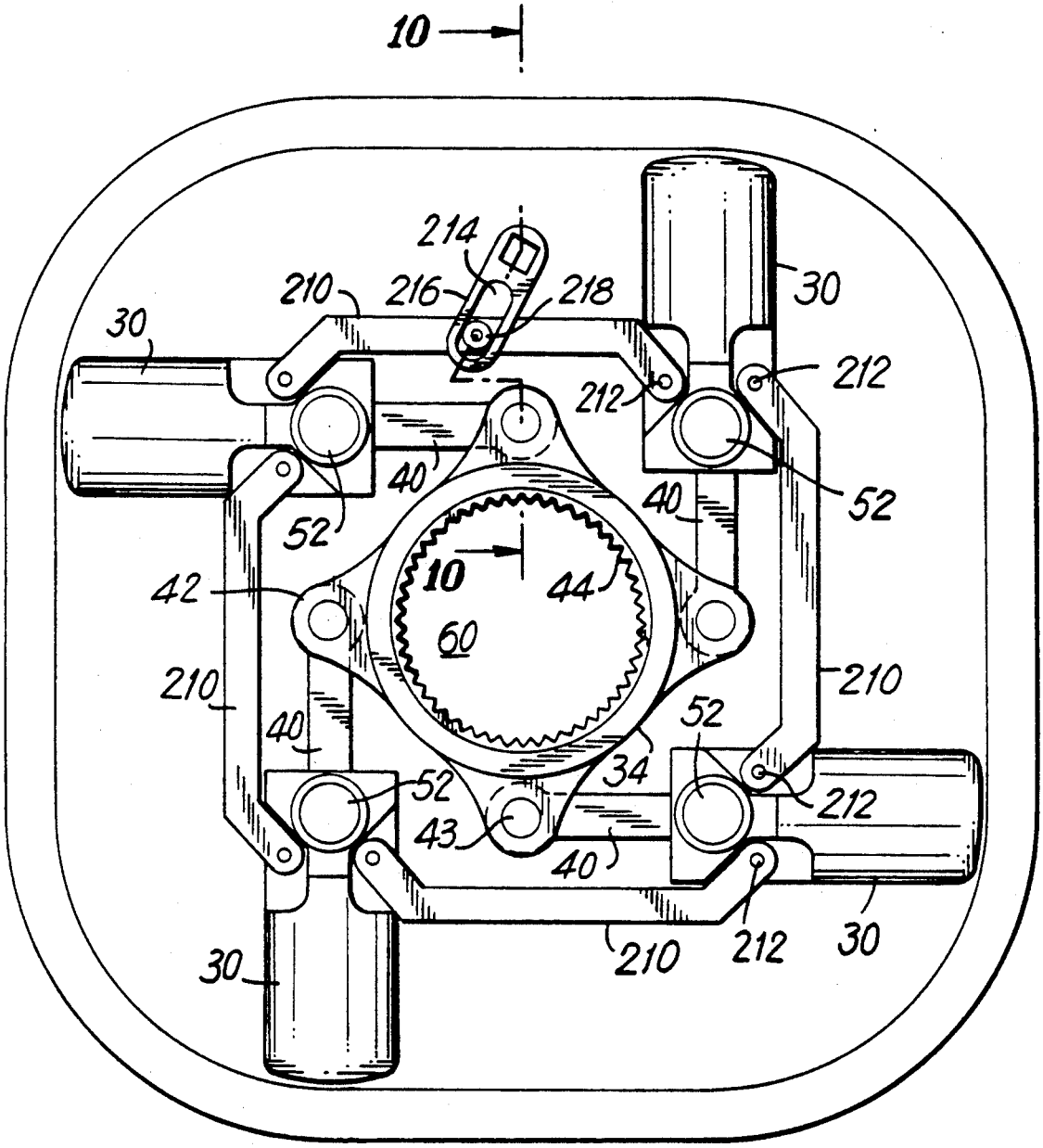
FIG. 9 is a top plan view of an alternative embodiment of the wrench with the front frame member removed illustrating an alternative selector means for rotating the cylinders.
Figure 10:
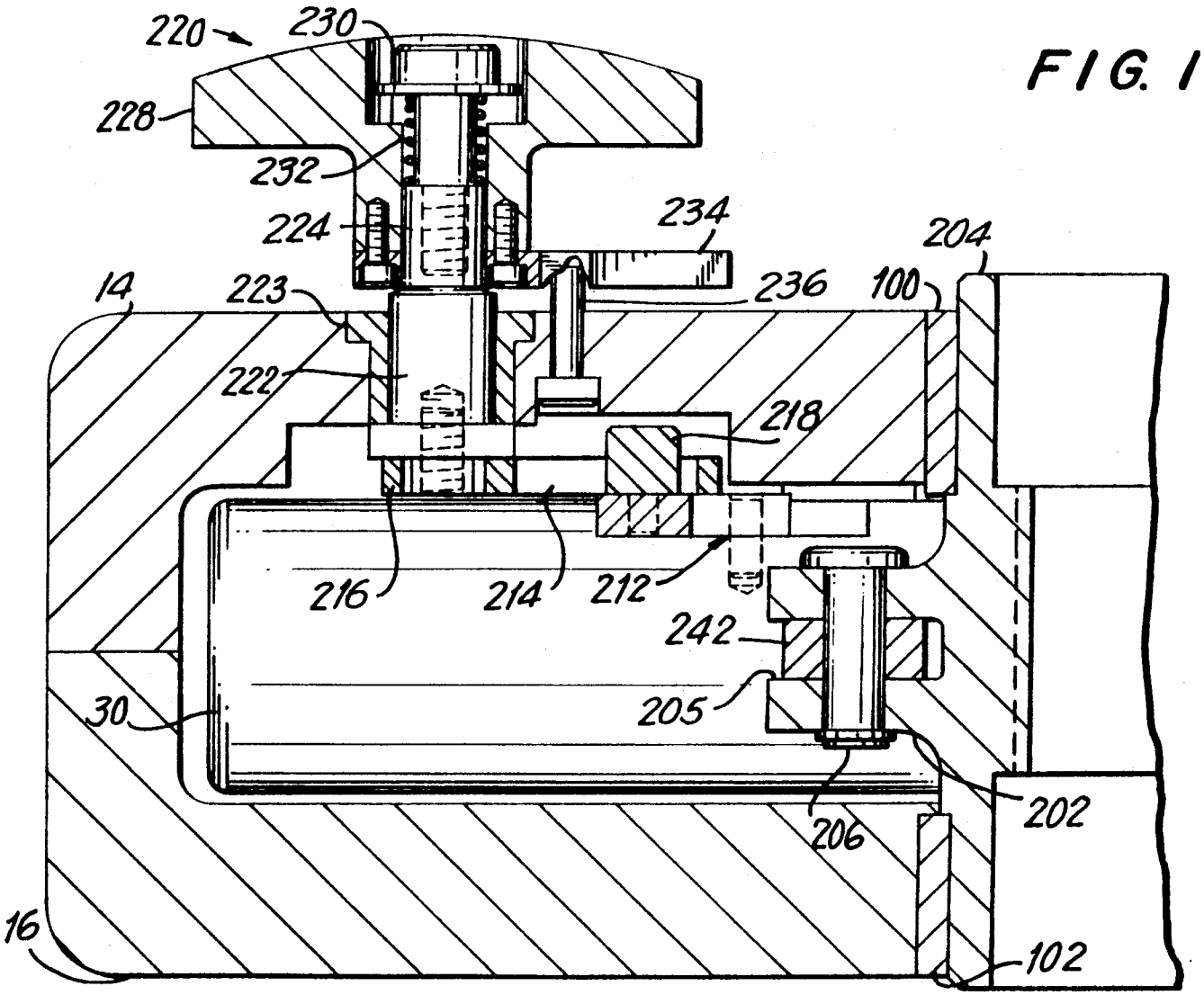
FIG. 10 is a partial section view of the alternative embodiment of the present invention shown in FIG. 9 as viewed through line 10—10.
Figure 11:
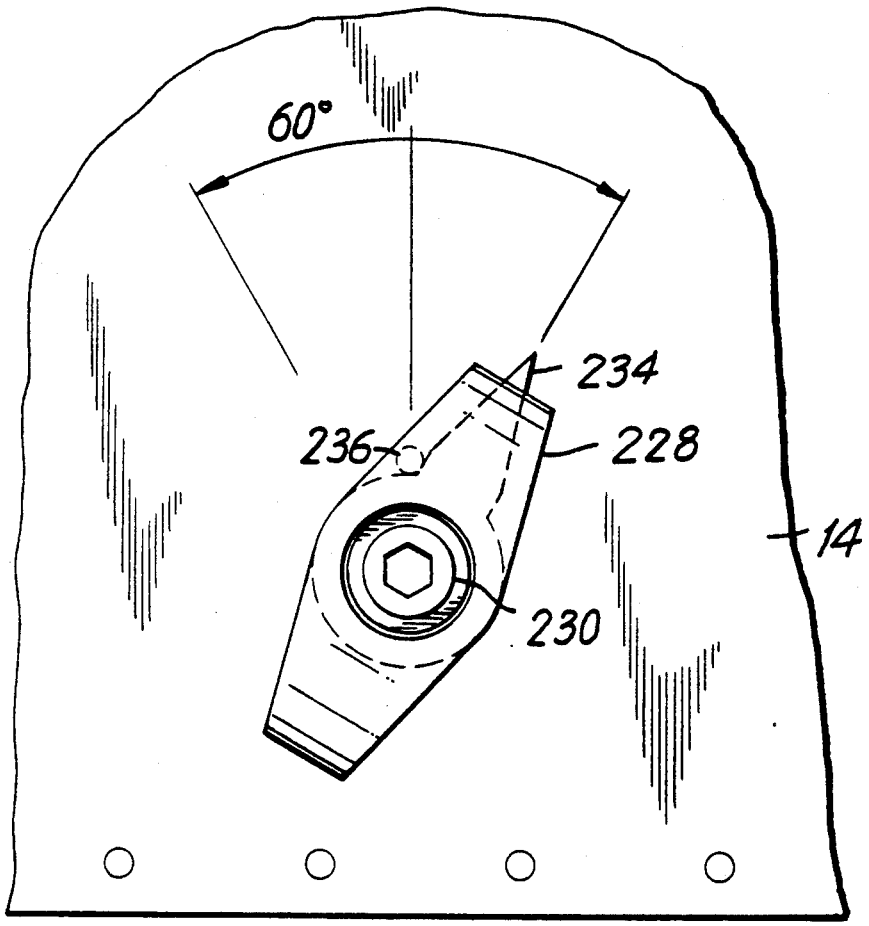
FIG. 11 is a partial plan view illustrating the handle assembly shown in FIG. 10.

An alternative embodiment of the wrench according to the present invention is illustrated in FIGS. 9–11. This embodiment utilizes a separate mechanical linkage for rotating the cylinders, and is thus also well suited for use with the invention described in applicant's U.S. Pat. No. 5,056,384, wherein the piston rods are not directly linked to the four-leg ratchet mechanism.

Referring to FIG. 9, four linkage members 210 are pivotably connected to the cylinders at pivot points 212 spaced a short distance away from pivot lugs 52. Slotted hole 214 in arm 216 cooperates with stud 218, located on one of the linkage members, to move the linkage member from side-to-side when arm 216 is rotated. Due to the positioning of the pivot points 212 with respect to the pivot lugs and the cooperating action of linkage members 210, movement of one linkage member causes all cylinders 30 to rotate around their respective pivot lugs.

Arm 216 is rotated by means of a handle assembly 220, illustrated in FIGS. 10 and 11. Arm 216 is secured to the bottom of upwardly extending shaft 222 in a manner that prevents rotation of the arm with respect to the shaft. Shaft 222 is rotatably carried in the front frame by bearing 223, which may be a self lubricating sleeve-type bearing. A square portion 224 of shaft 222 extends beyond front frame member 14. Handle 228, with a mating square recess, is placed over square portion 224 and secured by bolt 230. Spring 232 is disposed between handle 228 and bolt 230 such that the handle can be pulled upward, against the bias of spring 232. Indicator/stop 234 is fixed to the bottom of handle 228 and cooperates with pin 236, which also extends a short distance outwardly from front frame member 14 adjacent to shaft 222.

In order to rotate the cylinders, handle 226 is pulled upward, against the bias of spring 232, a distance which allows indicator/stop 234 to clear pin 236. Handle 226 is then rotated, causing arm 216 to move linkage members 210 by cooperating with stud 218 and thus rotate cylinders 30 around pivot lugs 52 and 54. As with the embodiment described above, the pistons must be fully retracted prior to rotation of the cylinders.

If the cylinders were actuated at the 45° orientation, that is,. with the pistons each acting along a line directly through the central axis of the wrench, the wrench would lock up and possibly be damaged if the condition was not immediately recognized. Handle assembly 220 prevents this condition from occurring because handle 226 will not return to the down position until indicator/stop 234 has cleared pin 236. The amount of travel from one side of the indicator/stop to the other is approximately 60°. Therefore, once indicator/stop 234 has cleared pin 236, the cylinders have travelled 15° beyond the 45° lock up position. Indicator/stop 234 and pin 236 prevent the cylinders from moving back, while leaving them free to move forward to a full 90° rotation position due to actuation of the cylinders and extension of piston rods 40.

As will be apparent to persons skilled in the art, various modifications and adaptations of the structure above described will become readily apparent without departure from the spirit and scope of the invention, the scope of which is defined in the appended claims.

In particular, specific embodiments of the present invention have been described utilizing two pairs of equal and diametrically opposed linear forces created by four fluid power cylinders acting on a four-leg ratchet mechanism. The application of forces in two opposed pairs is a minimum number of forces. As long as the basic principle and teaching of the present invention of the application of forces in diametrically opposed pairs is followed, any number of pairs of forces may be applied by hydraulic cylinders or other means to provide a torque wrench within the teachings of the present invention.

What is claimed is:

1. A torque wrench for applying torque to an article, comprising:

a frame defining a central aperture concentric with a central vertical axis;

drive means for converting linear force applied to said drive means to angular force and for engaging such article, said drive means to angular force and for engaging such article, said drive means being supported by the frame in said central aperture for rotation about the central vertical axis;

means for applying at least two pairs of equal and diametrically opposed linear forces to said drive means, said force-applying means comprising at least four fluid power cylinders disposed on the frame in opposed pairs acting through parallel lines spaced perpendicularly apart across the central aperture, said cylinders each having a piston rod pivotably linked to said drive means and applying equal, diametrically opposed linear forces thereto, said fluid power cylinders being disposed on the frame for rotation around pivot points; and selector means for selectively rotating said cylinders around said pivot points to provide for alternate rotation of the drive means in a clockwise direction and a counter-clockwise direction.

2. A torque wrench according to claim 1, wherein said selector means comprises a member extending from one of said cylinders beyond said frame, said extending member being adapted to be gripped and rotated, whereby rotation of said member rotates said one cylinder which cooperates with said drive means to rotate the cylinders around their respective pivot points due to the pivotable linkage of the piston rods with the drive means.

3. A torque wrench according to claim 2, wherein said drive means comprises:

a generally cylindrical body defining a central bore and having a number of legs corresponding to the number of fluid power cylinders, said legs extending radially from and equally spaced around the outer circumference of the cylindrical body, each of said legs defining a clevis pivotably receiving one of the piston rods; and ratchet means disposed within said central bore for engaging a tool for connection with the article to be rotated.

4. A torque wrench according to claim 1, wherein the force-applying means includes fluid supply means comprising:

internal fluid supply lines formed integrally with the frame and communicating with the cylinders; and means for providing actuating fluid under pressure, said fluid providing means communicating with said supply lines.

5. A torque wrench according to claim 4, wherein the actuating fluid is hydraulic fluid.

6. A torque wrench according to claim 4, wherein the actuating fluid is air.

7. A torque wrench according to claim 4, wherein the pressure providing means comprises a fluid power pump communicating with the fluid supply lines.

8. A torque wrench according to claim 7, wherein the pressure providing means comprises:

a pump mounted directly on said wrench communicating with the fluid supply lines, providing hydraulic fluid under pressure; and a reservoir integral with the pump for containing the hydraulic fluid supply, whereby the wrench is provided with an entirely self-contained hydraulic system.

9. A torque wrench for applying torque to an article, comprising:

a frame defining a central aperture concentric with a central vertical axis;

drive means for converting linear force applied to said drive means to angular force and for engaging such article, said drive means being supported by the frame in said central aperture for rotation about the central vertical axis;

means for applying at least two pairs of equal and diametrically opposed linear forces to said drive means, said force-applying means comprising at least four fluid power cylinders disposed on the frame in opposed pairs acting through parallel lines spaced perpendicularly apart across the central aperture, said cylinders each having a piston rod engaging said drive means and applying equal, diametrically opposed linear forces thereto, said cylinders being disposed on the frame for rotation around pivot points, and means for supplying actuating fluid to the cylinders; and selector means for selectively rotating the fluid power cylinders around the pivot points, said selector means comprising two rigid linkage members extending from each of said cylinders to adjacent cylinders around said drive means, said linkage member being pivotably secured to said cylinders at a point spaced away from said pivot points whereby movement of any one of said linkage members causes all of said cylinders to rotate about their respective pivot points, thereby providing a centrally balanced torque wrench capable of successively torquing in a clockwise and counter-clockwise direction without removing or turning over the wrench.

10. A torque wrench according to claim 9, wherein said selector means further comprises means for preventing the cylinders from being positioned to act along lines extending through the central vertical axis.

11. A torque wrench according to claim 10, wherein said preventing means comprises:

a shaft carried by the frame for rotation around an axis at least approximately parallel to the central vertical axis;

an extending arm rigidly disposed at an end of the shaft and cooperating with one of said linkage members;

handle means for gripping and rotating mounted on the shaft opposite the arm with at least a portion of the frame interposed between said handle means and the arm, said handle means rotationally being fixed with respect to the shaft and free for axial movement on said shaft and said handle means being biased onto the shaft towards the arm and said frame portion;

stop means extending from said handle means for engaging a stop member to prevent rotation of said handle means and the shaft; and a stop member extending a predetermined distance outwardly from said frame portion and cooperating with said stop means to selectively stop rotation of said handle means and the shaft by contact with said stop means, wherein said handle means may be pulled outwardly against said bias a distance greater than the predetermined distance to allow said stop means to rotate over the stop member with rotation of said handle means thereby rotating the cylinders beyond a position along lines extending through the central vertical axis.

12. A torque wrench according to claim 11, wherein said drive means comprises:

a generally cylindrical body defining a central bore and having a number of legs corresponding to the number of fluid power cylinders, said legs extending radially from and equally spaced around the outer circumference of the cylindrical body, each of said legs defining a clevis pivotably receiving one of the piston rods; and ratchet means disposed within said central bore for engaging a tool for connection with the article to be rotated.

13. A torque wrench for applying torque to an article, comprising:

a frame;

drive means for converting linear force applied to said drive means to angular force and for engaging such article, said drive means mounted centrally in said frame for rotation around a central axis;

a plurality of means for applying linear forces to said drive means, said force applying means each comprising a body member having extending lugs, said body members being mounted in the frame for rotation on said lugs from a first position to effect clockwise torquing rotation of the drive means to a second position to effect counterclockwise torquing rotation of the drive means, and an extendable force applying rod member pivotably linked to the drive means; and means for gripping and rotating the body member of one of said force applying means, whereby rotation of said body member rotates the rod member of said one of said force applying means which cooperates with the drive means to rotate the other rod members and thus rotate all force applying means between the first position and the second position.

14. A torque wrench according to claim 13, having four body members, said body members being fluid power cylinders, wherein said cylinders are evenly spaced on the frame 90° apart to apply equal and opposite diametrically opposed forces to the drive means and said rod members engage the drive means at points equidistant from the central axis.

15. A torque wrench according to claim 13, wherein the frame comprises first and second metal frame members, the body members being mounted between said frame members with the lugs rotatably received in apertures defined by said frame members, and wherein said gripping and rotating means comprises a member disposed on one of said lugs and extending through and beyond one of said frame members.

16. A torque wrench according to claim 13, wherein:

the drive means includes four radially extending legs located 90° apart, each leg defining a clevis; and the number of force applying means is four with said body members being located 90° degrees apart and each rod member being received in one of said clevises.

17. A torque wrench, comprising:

a frame, including two metal frame members, each member comprising a central support member defining a central aperture and at least one of said frame members defining passages there through adapted for the passage of hydraulic fluid;

drive means for converting linear force applied to said drive means to angular force and for engaging a device to be rotated, said drive means supported by the frame in the central aperture and comprising a generally cylindrical body defining a circular bore around a central vertical axis, a gear-toothed interior surface inside said cylindrical body, four legs extending radially from and equally spaced around the outer circumference of said cylindrical body, each of said legs defining a clevis, a ratchet wheel rotatably supported within the circular bore and adapted to hold a tool for engaging the device to be rotated, and a plurality of pawls pivotably supported on the ratchet wheel, said pawls biasly engaging the gear-toothed interior surface of the central bore and each pawl being selectively movable between a first position to provide driving engagement between the body and the ratchet wheel in a clockwise direction, and a second position to provide driving engagement in a counterclockwise direction;

four hydraulic cylinders pivotably supported on the frame around said drive means in an evenly spaced relationship to each other and communicating with the fluid passages, each cylinder having a piston rod pivotably linked to one of the clevises of the drive means to rotate said drive means and said four cylinders being evenly spaced on the frame to apply equal, diametrically opposed forces to the drive means, and said piston rods engaging the drive means at points equidistant from the central axis of the drive means;

means for supplying hydraulic fluid under pressure to said cylinders; and selector means for selectively rotating the cylinders around the pivot supports to alternately select the direction of rotation and torque application of the drive means, said selector means comprising a member extending from one of said cylinders beyond the frame, said extending member being adapted to be gripped and rotated, whereby rotation of said member rotates said one cylinder which cooperates with said drive means to rotate the cylinders around their respective pivot supports due to the pivotable linkage of the piston rods with the drive means.

18. A method for applying torque to an article comprising the steps of:

applying at least two pairs of equal and diametrically opposed linear forces to the article;

converting said linear forces to angular forces and thereby applying torque to the article without inducing side loading; and selectively rotating the direction of application of said at least two pairs linear forces in order to selectively apply torque in a clockwise or counterclockwise direction.

19. A torque wrench for applying torque to an article, comprising:

a frame defining a central aperture concentric with a central vertical axis;

drive means for converting linear force applied to said drive means to angular force and for engaging such article, said drive means being supported by the frame in said central aperture for rotation about the central vertical axis;

means for applying at least two pairs of equal and diametrically opposed linear forces to said drive means, said force applying means comprising at least four fluid power cylinders disposed on the frame in opposed pairs acting through parallel lines spaced perpendicularly apart across the central aperture, said cylinders each having a piston rod pivotably linked to said drive means to transmit said forces thereto, said fluid power cylinders being disposed on the frame for rotation around pivot points; and selector means for selectively rotating said cylinders around said pivot points to provide for alternate rotation of the drive means in a clockwise direction and a counter-clockwise direction, said selector means comprising a member extending from one of said cylinders beyond said frame, said extending member being adapted to be gripped and rotated, whereby rotation of said member rotates said one cylinder which cooperates with said drive means to rotate the cylinders around their respective pivot points due to the pivotable linkage of the piston rods with the drive means.

20. A torque wrench according to claim 19, wherein said drive means comprises:

a generally cylindrical body defining a central bore and having a number of legs corresponding to the number of fluid power cylinders, said legs extending radially from and equally spaced around the outer circumference of the cylindrical body, each of said legs defining a clevis pivotably receiving one of the piston rods; and ratchet means disposed within said central bore for engaging a tool for connection with the article to be rotated.

* * * * *

UNITED STATES PATENT AND TRADEMARK OFFICE

CERTIFICATE OF CORRECTION

PATENT NO. : 5,203,239

DATED : April 20, 1993

INVENTOR(S) : Anthony J. Sergan, et al

It is certified that error appears in the above-indentified patent and that said Letters Patent is hereby corrected as shown below:

Column 11, Claim 1, lines 11-12, delete "to angular force and for engaging such article, said drive means".

Signed and Sealed this

Twenty-second Day of March, 1994

*Attest:*

Bruce Lehman

BRUCE LEHMAN

*Attesting Officer*

*Commissioner of Patents and Trademarks*